US006633041B2

(12) United States Patent
Felter

(10) Patent No.: US 6,633,041 B2
(45) Date of Patent: Oct. 14, 2003

(54) METHOD FOR ANALYZING THE MASS OF A SAMPLE USING A COLD CATHODE IONIZATION SOURCE MASS FILTER

(75) Inventor: Thomas E. Felter, Livermore, CA (US)

(73) Assignee: Sandia National Laboratories, Livermore, CA (US)

( * ) Notice: Subject to any disclaimer, the term of this patent is extended or adjusted under 35 U.S.C. 154(b) by 0 days.

(21) Appl. No.: 10/245,656

(22) Filed: Sep. 16, 2002

(65) Prior Publication Data

US 2003/0015658 A1 Jan. 23, 2003

Related U.S. Application Data

(62) Division of application No. 09/315,001, filed on May 19, 1999, now Pat. No. 6,452,167.
(60) Provisional application No. 60/086,349, filed on May 20, 1998.

(51) Int. Cl.[7] ..... H01J 49/14
(52) U.S. Cl. ..... 250/423 R; 250/424; 250/423 F; 250/282

(58) Field of Search ..... 250/423 R, 424, 250/427, 423 F, 281, 282

(56) References Cited

U.S. PATENT DOCUMENTS 6,452,167 B1 * 9/2002 Felter ..... 250/423 R

* cited by examiner

*Primary Examiner*—Kiet T. Nguyen
(74) *Attorney, Agent, or Firm*—Timothy P. Evans

(57) ABSTRACT

An improved quadrupole mass spectrometer is described. The improvement lies in the substitution of the conventional hot filament electron source with a cold cathode field emitter array which in turn allows operating a small QMS at much high internal pressures then are currently achievable. By eliminating of the hot filament such problems as thermally "cracking" delicate analyte molecules, outgassing a "hot" filament, high power requirements, filament contamination by outgas species, and spurious em fields are avoid all together. In addition, the ability of produce FEAs using well-known and well developed photolithographic techniques, permits building a QMS having multiple redundancies of the ionization source at very low additional cost.

5 Claims, 8 Drawing Sheets

METHOD FOR ANALYZING THE MASS OF A SAMPLE USING A COLD CATHODE IONIZATION SOURCE MASS FILTER

CROSS REFERENCE TO RELATED APPLICATIONS

This application is a division of co-pending prior U.S. patent application Ser. No. 09/315,001 originally filed May 19, 1999 and now U.S. Pat. No. 6,452,167 and entitled "MINIATURE QUADRUPOLE MASS SPECTROMETER HAVING A COLD CATHODE IONIZATION SOURCE" from which priority is claimed. Which claims benefit of Provisional No. 60/086,349 filed May 20, 1998. +gi

STATEMENT OF GOVERNMENT INTEREST

This invention was made with Government support under contract DE-AC04-94AL85000 awarded by the U.S. Department of Energy to Sandia Corporation. The Government has certain rights in this invention.

BACKGROUND OF THE INVENTION

The present invention relates generally to the field of high-frequency multipole mass spectrometry and more particularly to a miniaturized mass spectrometer using a silicon chip field emitter array as the source of electrons for impact ionization of chemical species.

The number of applications for Quadrupole Mass Spectrometers ("QMS") continues to increase. QMS instruments are used in the analysis of the environment for contaminants, medical testing and the development of new pharmaceuticals, energy research and biochemical analysis. Some QMS instruments are complex and relatively expensive research-grade instruments for biomedical and biochemical applications such as deducing the structure of proteins or the sequencing of DNA. On the opposite end of the spectrum, small, simple and inexpensive QMS devices are used as routine detectors for gas chromatography. Other types of QMS spectrometers are used by government agencies, for example in backpack portable instruments for in-situ analysis of hazardous chemicals in the environment, in mobile battlefield laboratories to warn of impending chemical or biological attack, or in enormous machines for the separation of atomic isotopes.

The ever-broadening range of applications of QMS spectrometers places ever-increasing demands on the performance of these devices. Unfortunately, existing technology has not always met current needs. New applications tend to require more specific, reliable mass analysis and more sensitive detection of ions having large mass-to-charge ratios which the current inventory of instruments cannot provide. However, this large, installed base of mass spectrometers represents a large and considerable capital investment in equipment and personnel that cannot readily be abandoned. Thus there is a desire to upgrade and improve the capabilities of existing instruments to meet the new demands.

Brief History of the Prior Art

The quadrupole mass filter is roughly 40 years old and is today widely used in a broad range of vacuum based instrumentation. Applications include sensitive leak detection, residual gas analysis, thermal desorption mass spectroscopy, molecular beam analysis, and detection in liquid and gas chromatography. Traditionally, these instruments have been very large laboratory devices owning principally to their need for very clean, very high rate vacuum systems, for high energy ionization sources and associated ion beam handling equipment, for sensitive detectors, and for heavy and sophisticated plumbing systems necessary to construct and house these instruments.

Since their development, multipole and in particular the QMS spectrometers have gained considerable scientific and commercial importance in many diverse fields ranging from chemical analysis to the establishment of highly precise atomic time standards. U.S. Pat. No. 2,939,952 entitled "Apparatus for Separating Charged Particles of Different Specific Charges" to Wolfgang Paul, et al., first describes the development of these devices. Many of the basic electrode configurations and anticipated uses for quadrupole mass filters are as shown or predicted in the '952 patent. Today, most of the analytical mass spectrometers in use are of the quadrupole type. The proliferation and wide acceptance of QMS spectrometers can be attributed to their simplicity, reliability, and low cost compared to other types of mass spectrometers.

U.S. Pat. Ser. No. 5,464,975 provides a brief recitation regarding conventional prior art QMS systems. These systems are shown to consists of the following components (see FIG. 1): a sample inlet 1; an ion source 2 for converting the sample into charged species of certain mass-to-charge (m/z) ratios; a quadrupole mass filter 3 (also called a quadrupole mass analyzer) that preferentially passes one m/z ratio at a time; and a detector 4 to detect the abundance of the transmitted charged particles. By scanning the RF and DC voltages applied to the quadrupole mass filter, a mass spectrum can be generated, showing signal intensity, correlated to relative abundance (in arbitrary units), versus the m/z ratio (in Dalton units).

In most current mass spectrometers, the ionizer section comprises what is commonly known as a hot filament, using essentially vacuum tube technology, or a radioactive source for producing a stream of electrons or other high energy charged particles. It is these high energy species which serve to ionize the analyte stream thereby ionizing some portion of the material within the stream and which are subsequently separated in the quadrupole mass filter.

However, hot filaments and radioactive sources exhibit a number of disadvantages. Environmental and health and hygiene concerns limit the latter sources to essentially fixed laboratory facilities. Furthermore, high energy sources, especially those producing heavy particles, are intended to produce dissociation fragments of the parent molecule. This includes hot filament electrodes which exhibit a tendency to damage delicate molecules under analysis. Hot filaments also exhibit a property known as "outgassing" wherein the operation of the filament not only produces electrons but also "boils" off metal atoms comprising the filament itself or absorbed or adsorbed species such as hydrogen, carbon monoxide/dioxide, and water, etc. This outgassing degrades the system cleanliness and reduces the high vacuum integrity of the system and, in turn, requires the use of large, rapid, and very expensive vacuum pumps in order to maintain operational pressures $<10^{-9}$ Torr.

The instant application describes a modification to the QMS spectrometer which overcomes some of the shortcomings of prior art devices. The instant invention improves upon the performance of the QMS and suggests a route to miniaturization, portability, and instrument operation at higher pressures; features which are beyond the present state-of-the-art. The improvements embodied in the instant application apply equally well to the closely related monopole and multipole mass spectrometers. The improvement in QMS systems disclosed and described in the present work comprises the use of a Field Emitter Array ("FEA") as the ionizing source for producing of electrons for impact ionization in a QMS. In particular, the FEA described herein is manufactured by means similar to those used for silicon integrated circuit ("IC") fabrication. Briefly, FEAs consist of a large number, (typically hundreds to tens of thousands) of sharp microscopic tips, each one of which is in close proximity to an electrode called a gate. Modest voltages (generally <100 Volts) applied between the gates and the emission tips produce a high concentration of field lines on these tips. This, in turn, causes electron emission via tunneling through the work function barrier of the material comprising the tips into the vacuum.

The ionizer section of the instant invention, therefore, uses a cold cathode FEA in place of the typical hot filament electron gun source. This arrangement retains the advantages of high electron fluxes and fragmentation patterns to distinguish between species having the same mass (such as CO and $N_2$) while avoiding deleterious effects of the hot filament source. Furthermore, miniaturization affords redundancy in the electron source beyond the customary two filaments used in conventional mass spectrometers.

Earlier attempts at finding new and different ionization sources have been addressed in U.S. Pat. Nos. 3,852,595 and 4,988,869, both to Aberth, and in U.S. Pat. Ser. No. 5,278,510 to Baptist.

The first of these references describes a high voltage electrode comprising an array of sharp projections on a conductive substrate. In this approach, Aberth suggests producing a high electric field by impressing an electrical potential of about 3600V across the substrate and a control grid spaced apart from and parallel to the plane of the array of projections. Ionization occurs when a gas or otherwise entrained sample is passed through the electric field. In the second approach, Aberth suggests using a field emission device to provide an electron current. This device, however, is similar to Aberth's earlier electron source comprising a plate having a plurality of sharp protrusions on its surface. An electron stream is generated by impressing a potential between the plate and an electrically conductive grid parallel to and removed above the surface of the plate. This arrangement is also shown to be short range having a effective operational distance above the grid of no more than about a few tenths of centimeters. By way of contrast, the instant invention teaches an integrated FEA chip having emission tips each surrounded by an emission gate, rather than a remotely located grid, which produce electrons which are accelerated into an ionization chamber.

In the last of these references, U.S. Pat. No. 5,278,510 to Baptist, an ionization vacuum gauge is described which uses an electron source comprising a micropoint cathode and teaches that the technique for producing electrons via a field effect from such emissive micropoint is " . . . fully known . . . " and previously described in U.S. Pat. Nos. 4,857,161 and 4,940,916.

SUMMARY OF THE INVENTION

Accordingly, the present invention provides a method and an apparatus for producing very high electron fluxes which are useful for causing collision-induced molecular dissociation.

Another object of this invention is to provide a means for easily retrofitting existing installed multipole mass spectrometers as well as adapting newly manufactured designs.

Yet another object of this invention is to provide a source of electron flux which is at once intense and essentially inert to the analyte species under investigation.

Another object of this invention is to provide a QMS wherein the ionizing electrons are generated by a cold cathode Field Emission Array.

Another object of this invention is to provide a QMS wherein the ionizing flux is remotely generated and subsequently directed into the analyte sample.

Another object of this invention is to provide a QMS capable of operating at internal pressure regimes below about $10^{-3}$ Torr and above about $10^{-10}$ Torr.

Another object of this invention is to provide a QMS capable of operating at internal pressure regimes above about $10^{-3}$ Torr and below about $10^{-10}$ Torr.

Yet another object of this invention is to provide a QMS which is greatly smaller than existing devices.

Another object of this invention is to provide a mass spectrometer which generates no stray light during operation.

A further object of this invention is to provide a mass spectrometer having an electron source with greater redundancy and therefore a spectrometer with greater reliability and a longer operational life.

Further understanding of the nature and advantages of the invention will become apparent by reference to the remaining portions of the specification and drawings. Other objects, advantages and novel features, and further scope of applicability of the invention will become apparent to those skilled in the art upon examination of the following drawings and description, or may be learned upon practicing the invention. The objects and advantages of the present invention may be realized and attained by means of the instrumentalities and combinations particularly pointed out in the appended claims

BRIEF DESCRIPTION OF THE DRAWINGS

The accompanying drawings, which are incorporated into and form a part of the specification, illustrate a general, preferred embodiment of the present invention and, together with the description, serve to explain the principles of the invention. The drawings are intended to be used only for the purpose of illustration and are not to be construed in any way as limiting the scope of the invention described herein. In the drawings.

DETAILED DESCRIPTION OF THE INVENTION

Figure 1:
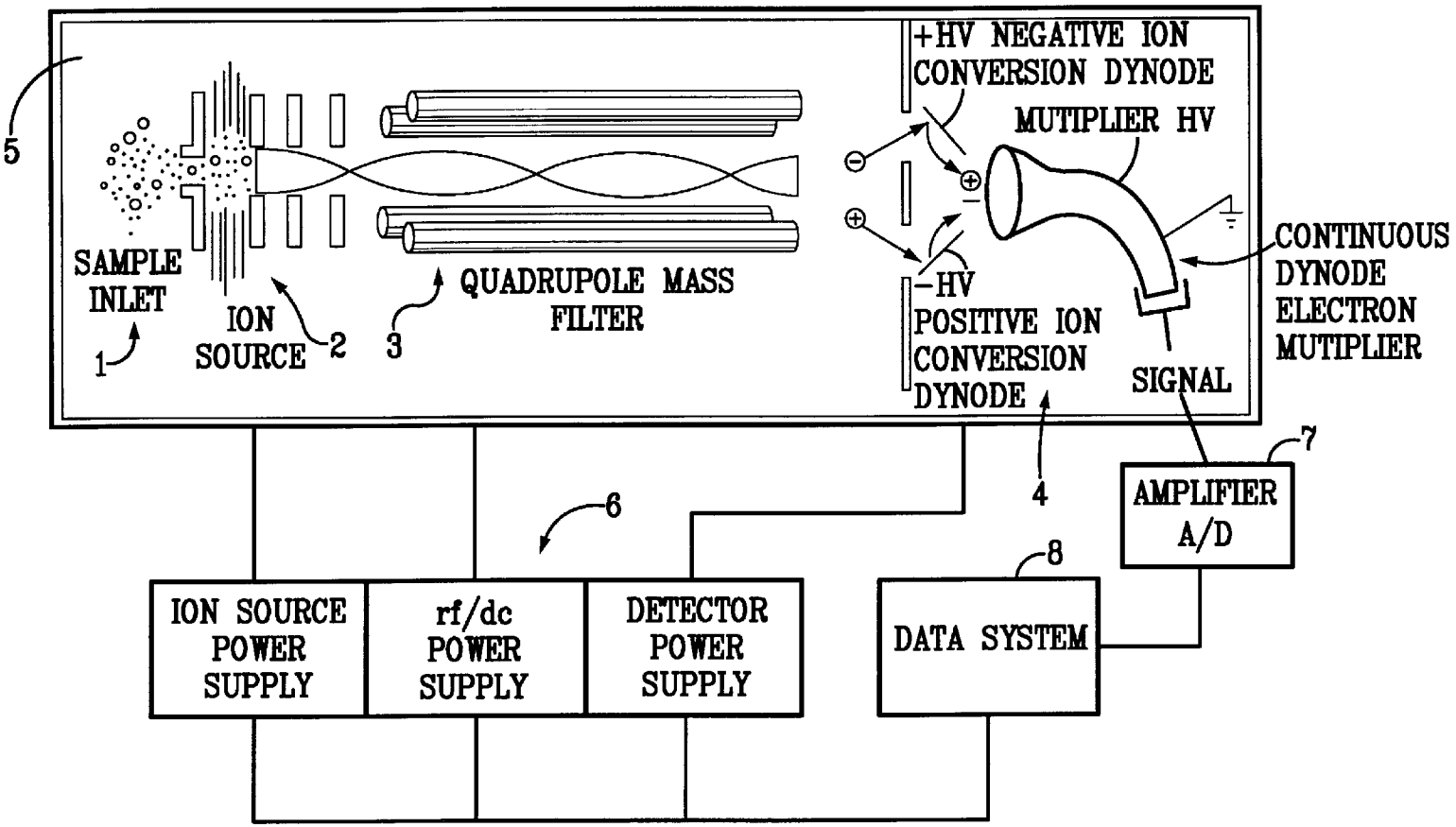
FIG. 1 Prior Art
FIG. 1. Illustrates a prior art mass spectrometer.

A schematic representation of a typical QMS spectrometer in the prior art is shown in FIG. 1 The system consists of a sample inlet 1, an ion source 2, a quadrupole mass filter 3 and a detector 4. The ion source, mass filter and detector are placed in an evacuated housing 5. Power supply electronics 6 provide all the necessary voltages to operate the mass spectrometer system. An amplifier and analog-to-digital converter 7 registers the detector signal, which is read into control computer 8 for processing and display to the user. Computer 8 also provides control signals for the power supply electronics.

Mass spectrometers can not be based on electrostatic fields alone; rather, ions must be separated by magnetic field (as in sector spectrometers) or by characteristic time structure (as in time-of-flight spectrometers). The QMS achieves time structure in a particularly elegant way by connecting opposite poles electrically and modulating these pole pairs with a simple high frequency waveform. The waveform consists of a DC component, $V_{dc}$, of equal voltage for the two pairs but of opposite polarity (as shown by the + and − signs in FIG. 2) combined with an AC component, $\pm V_{rf} \sin 2\pi\omega t$, i.e. 180° out of phase for the pairs, again shown by the + and − signs. The beauty of the spectrometer lies in the fact that mass (actually measured as a charge-to-mass ratio) and resolution are selected by the voltages of $V_{dc}$ and $V_{rf}$, not by large currents through an electromagnet and mechanical adjustment of precision slits as in the prior art.

Figure 3:
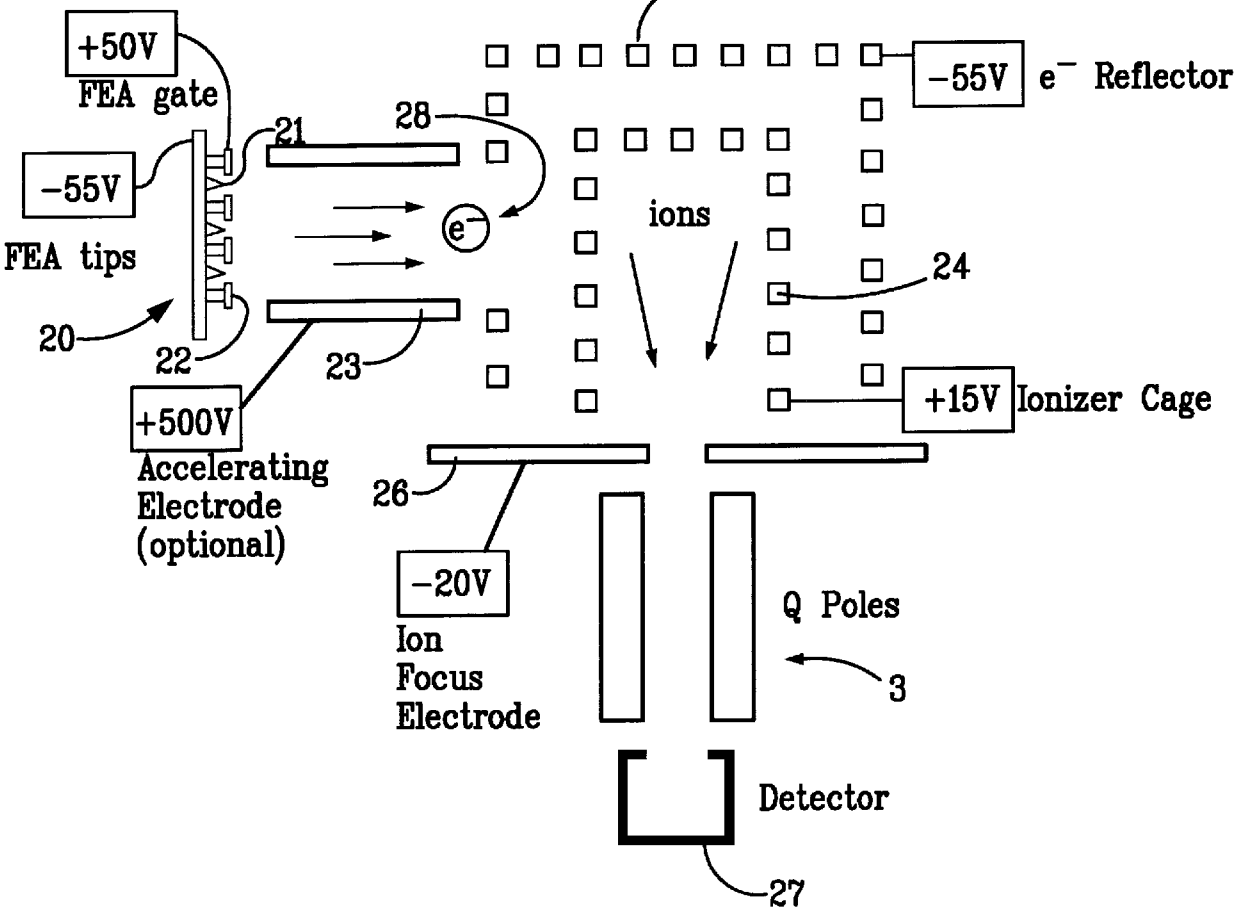
FIG. 3. Shows a schematic of a modified QMS.

A modified UTI® 100C QMS was used in the instant invention and is shown schematically in FIG. 3. The device comprises a low voltage array 20 of field emission tips 21 and gates 22, an acceleration tube 23, an ionization cage 24 surrounded by an electron reflector 25 held at the same potential as emission array 20, an ion focus electrode 26, a mass filter (the quadrupole) 3, and a detector 27. Tips 21 of FEA 20 are biased like a customary hot filament so that upon entering ionizer cage 24 (within reflector 25) the emitted electrons 28 have the same kinetic energy and therefore ionization probability as for a conventional electron dispenser.

A short, positively-biased stainless steel tube 23 located before the reflector cage 25 produces a field at the cold-cathode that prevents emitted electrons 28 from "shorting" to the FEA gates 22. FEAs are currently very efficient. Typically less than 1% of the emitted current appears as leakage to the gate, and FEAs can produce stable controllable currents in the range required for mass spectrometer ionizers. We chose 0.1 mA emission current stabilized by a load resistor of 10 Mohms. Feedback circuits to insure constant current, even in the presence of work function altering gases, are easy to implement, but were not required in the present work. We found that the potential on the tube was not critical, as long as it was more positive than the FEA gate potential.

Figure 4:
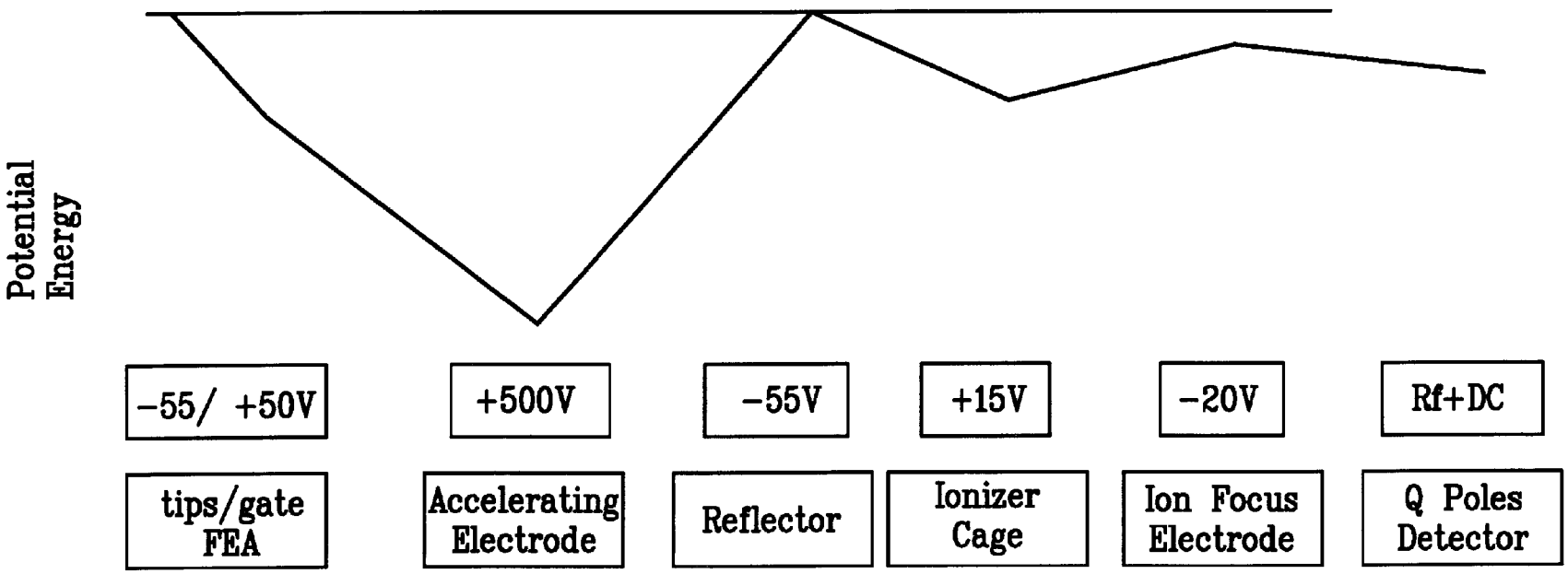
FIG. 4. Presents a schematic of a potential energy diagram of the FEAQMS.

FIG. 4 shows the potential energy diagram of the device. Electrons are emitted from the tip and drop to a potential approaching that of the gate electrode and then continue to "fall" into the tube. They coast through the tube and enter the reflector region after being decelerated. Trapped in the ionizer section, they traverse hundreds of times before being collected by the inner cage. Atoms that are ionized in the cage are drawn by the ion focus electrode into the quadrupole section and then analyzed for charge to mass ratio.

Figure 5:
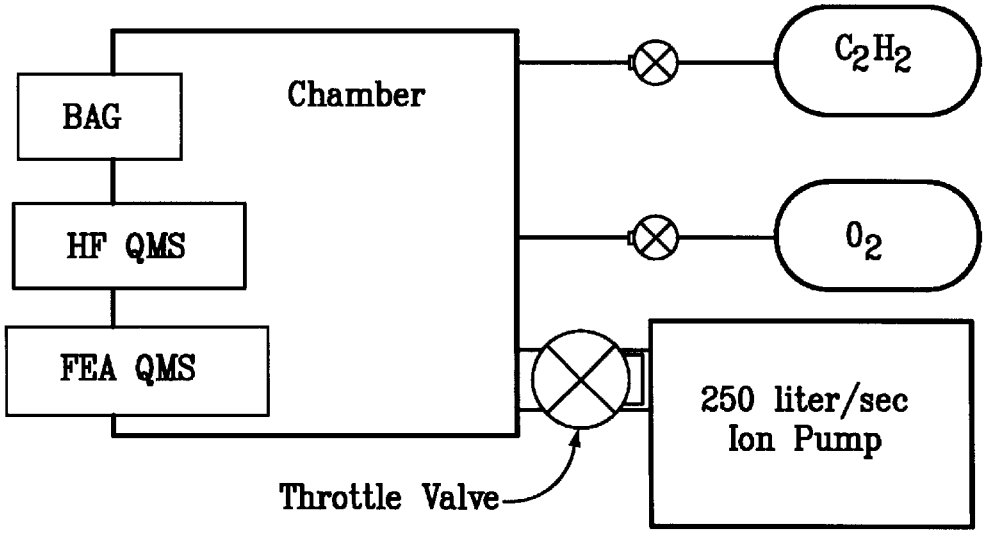
FIG. 5. Illustrates the test chamber equipped with the FEAQMS as well as an ionization gauge and a hot filament only QMS.

The cold-cathode QMS spectrometer was tested in a standard stainless steel apparatus shown schematically in FIG. 5. Small acetylene and oxygen reservoirs with leak valves were available, together with a throttle valve and a 300 l/s VACION® vacuum pump. A conventional hot filament Bayard-Alpert gauge ("BAG"), and a second, hot-filament only, UTI® 100C QMS were located approximately 200 mm from the field emission array quadrupole mass spectrometer ("FEAQMS").

Figure 6:
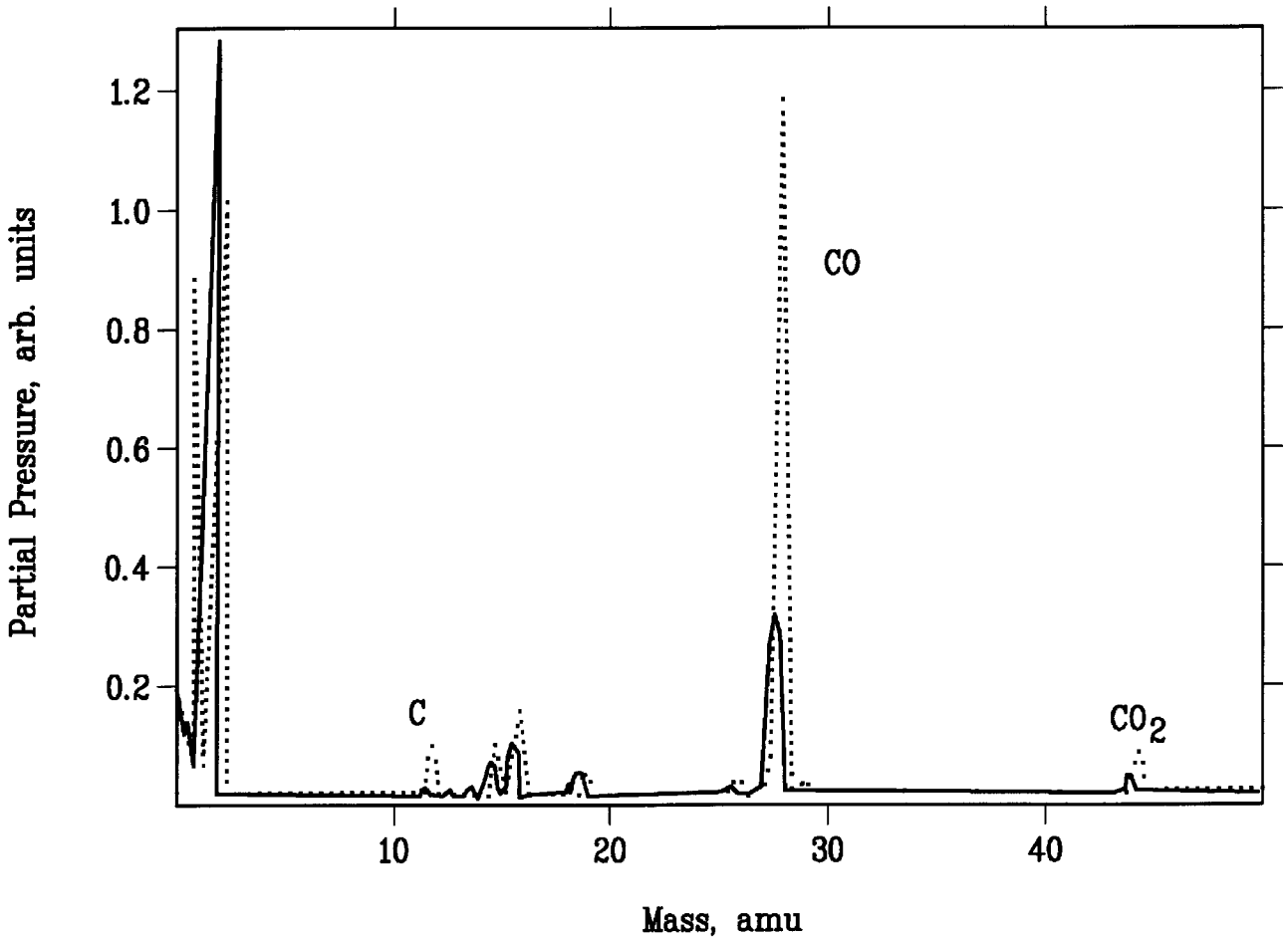
FIG. 6. The spectra generated by the FEAQMS showing lower background gases when external hot filaments are turned off. (The spectrum with the dashed line was obtained with the FEAQMS in the presence of external hot filaments that had run overnight. The solid line spectrum was taken within a few minutes of turning off these well-outgassed hot filaments.)

Mass spectra covering the range 0 to 50 AMU were obtained at roughly $5\times10^{-9}$ Torr. With the throttle fully open and the leaks closed, the background spectra of FIG. 6 show the customary residual gases of ultra-high vacuum. The spectrum with filaments on (dashed line) was obtained after many days of continuous operation to minimize outgassing. Nevertheless, upon turning off the filaments (solid line) considerable improvement was seen even within the first complete mass scan while the flanges remained warm to the touch. Specifically, the CO peak, mass 28, and the $CO_2$ peak, mass 44 decrease by factors of three and two respectively. When the filaments are re-energized, large mass peaks appear and slowly decrease toward the levels shown in the dashed curve. Clearly, the FEA is preferable in cases where residual gases in the $10^{-10}$ Torr range and below are required. This regime is becoming more common in standard stainless steel and more exotic systems, such as those fabricated from aluminum.

To assess the operation of the mass spectrometer at higher pressures, we introduced roughly equal rates of acetylene and oxygen yielding a total pressure of $10^{-7}$ Torr. We found no change whether the auxiliary mass spectrometer and/or the BAG were on. In short, the contribution of the hot filaments to the background level was small compared to the load introduced by the open leaks. This test also showed that stray electrons from the BAG and auxiliary QMS do not contribute to extra ionization in the FEA-based QMS.

Figure 7:
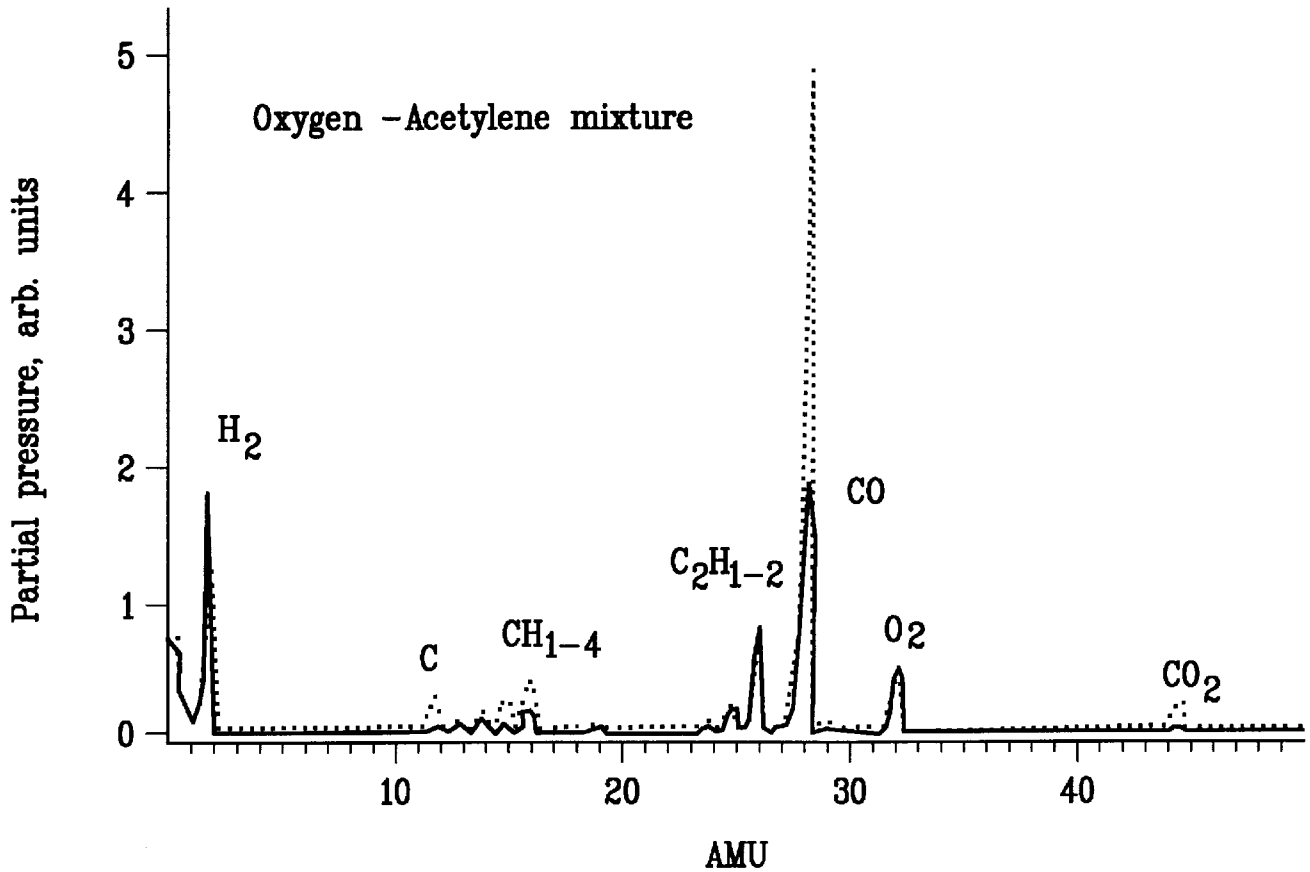
FIG. 7 Illustrates now a reduction in vacuum chamber pumping speed, the auxiliary hot filaments produces unwanted chemical reactions of gas sample.

Finally, we considered the effects of pumping speed on the relative merits of hot and cold-cathode operation. First, we reduced the leaks equally to achieve $10^{-9}$ Torr, and then cut the throttle to increase the pressure back to approximately $1\times10^{-7}$ Torr. (This effectively reduced the pumping speed by a factor of 100 to approximately 3 liters per second.) Under these circumstances, the mass spectra are quite different for the filament ON/OFF cases as is clearly seen in FIG. 7. When the filaments of the BAG and the auxiliary mass spectrometer are turned on (at pressures of approximately $1\times10^{-7}$ Torr), the CO peak dominates the spectrum (dashed line). However, with the hot filaments off, the CO peak is reduced by approximately a factor of three, and the $O_2$ (32 AMU) and $C_2H_2$ (26 AMU) peaks are larger by factors of two and three, respectively (solid line). This is interpreted as being caused by the hot filament catalyzing a reaction of acetylene and oxygen to form CO. Hydrogen released in the process, as well as some background $H_2$, is consumed in the formation of methane, 16 AMU. We also find that oxygen alone, without acetylene, combines with residual hydrogen to cause substantial increases in the water (18 AMU) peak when hot filaments are present.

These results suggest some of the effects that can be caused by chemical reactions of even simple analytes with the hot filaments of the conventional QMS and by the increase in gas background. Furthermore, the problems associated with hot filaments are aggravated in situations where pumping speed is minimal. Additional problems associated with hot cathodes include large power consumption of the filament itself, heating of chamber walls and generation of stray light. The latter effect, stray light, can photo-dissociate delicate molecules and can interfere with complementary measurements that require the detection of light. Hot filaments also suffer from a limited operational life especially in aggressive environments which might include vibration and/or contact with corrosive species.

In contrast, FEAs are monolithic structures amenable to coating by inert materials, thus generally isolating them from severe environments. FEAs afford performance that is unachievable with hot filaments, such as vastly superior current density and the ability to be pulsed and controlled extremely rapidly. Special wave forms can enable phase sensitive and other detection techniques to discriminate against background contributions and other artifacts particularly for molecular beam work.

While the power saving in the use of an FEA over a hot filament is significant and can help reduce size and weight, it is the lower reactivity and outgassing that most enables portability. These features permit the use of smaller, lighter pumps that draw less power thereby leading to a tremendous saving in weight. Furthermore, the small size of the FEA lends itself to small ionizers and therefore to small quadrupole structures. Miniaturization further improves portability by decreasing the size and weight of the required vacuum enclosure permitting smaller, lighter pumps that use much less power. Moreover, smaller physical size implies shorter acceptable mean free path lengths which in turn allows for larger pressure operation before filtered ions are scattered by residual gas molecules. This relaxes vacuum and pumping requirements still further.

The mass filter rods on the UTI® 100C are on the order of 10 cm in length, which is typical of other commercial units. FERRAN SCIENTIFIC® however, markets devices on the order of 1 cm in length. Present day FEAs have an active area of 0.1 $mm^2$ implying that a miniature mass spectrometer with rods of length L=1 mm may be practical. Individual FEA pixels in prototype FEDs (field emitter displays) are approximately 100 microns in diameter containing hundreds of tips and suggest the possibility of microminiature mass spectrometers with L=100 microns. Ferran et al. recognized that the acceptance area of a mass spectrometer decreases with size and pioneered the use of multipoles to counter this effect: his spectrometers employ 16 poles. For the miniature mass spectrometer, hundreds of poles might be used and for the microminiature, thousands. Microfabrication techniques should provide this level of integration.

It is instructive to consider further the cases of miniature and microminiature QMS.

Figure 2:
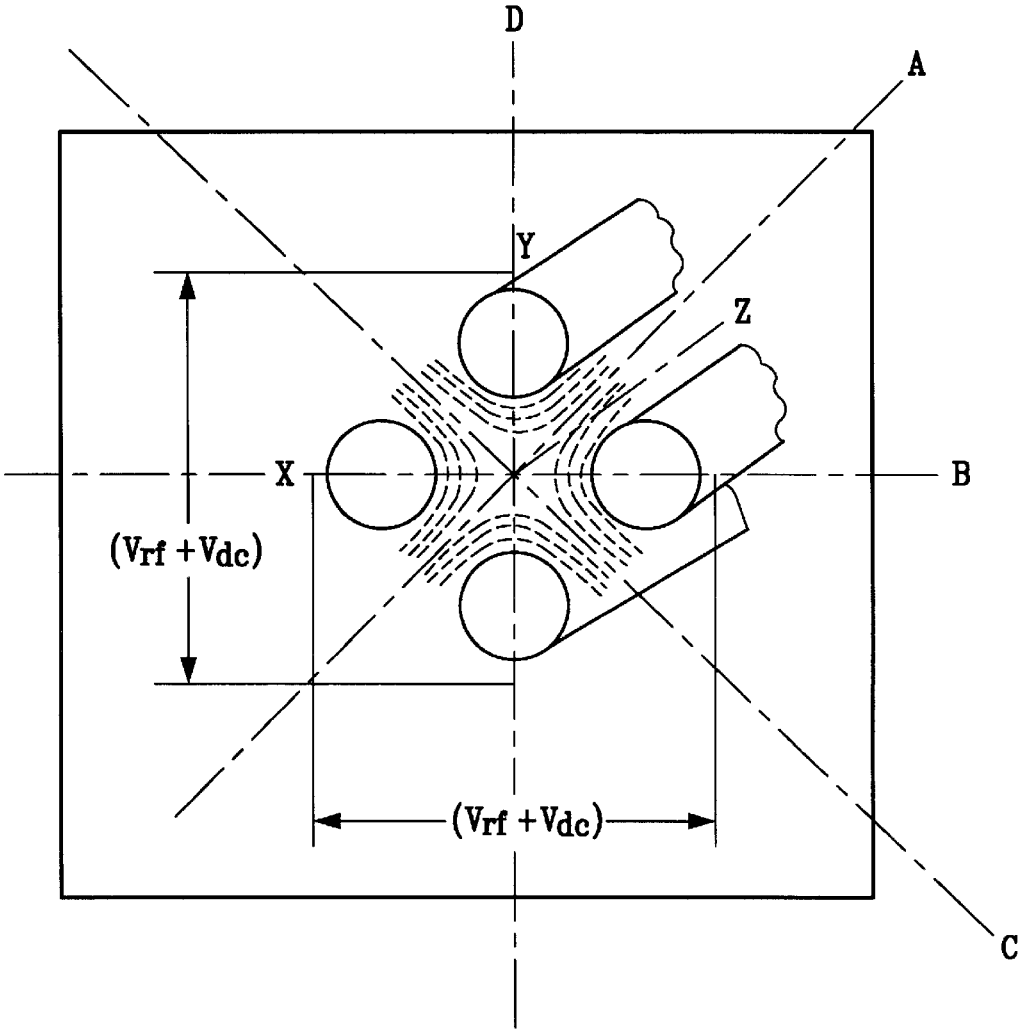
FIG. 2. Illustrates the quadrupole mass filter. Opposite poles are connected electrically and driven by the sum of a high frequency AC and DC signal.

The fundamental properties of the QMS are set by L together with the maximum RF voltage amplitude, V, its frequency, f, and the inscribed radius, $R_0$. The latter is one half the gap distance between opposite poles as shown in FIG. 2 and is 1.148 times smaller than the rod diameter. The maximum mass that can be filtered is $M_m$, where:

$$M_m = \frac{7\times10^6\ V}{f^2 R_o^2} \tag{1}$$

Resolution is defined by dividing this by the minimum attainable peak width, ΔM:

$$\frac{M_m}{\Delta M} = \frac{L^2 V}{570\ V_z R_0^2} \tag{2}$$

where $V_Z$ is the ion injection energy.

Equation 1 shows that the maximum range can be maintained for small mass spectrometers provided that the frequency is correspondingly increased. The 1 cm long Ferran spectrometers run at 40 MHz, so this implies 400 MHz operation for 1 mm long rods, and 4 GHz operation for 100 micron rods. The 1 mm rods would seem to present little problem with respect to frequency since the electronics industry has progressed to the point where control circuitry exhibiting bus rates of several hundred megahertz are not unusual. It is interesting to note that FEAs are being developed for GHz radar applications, so that the RE drivers for the 100 micron rods might be FEAs or more conventional cellular phone circuits.

Figure 8:
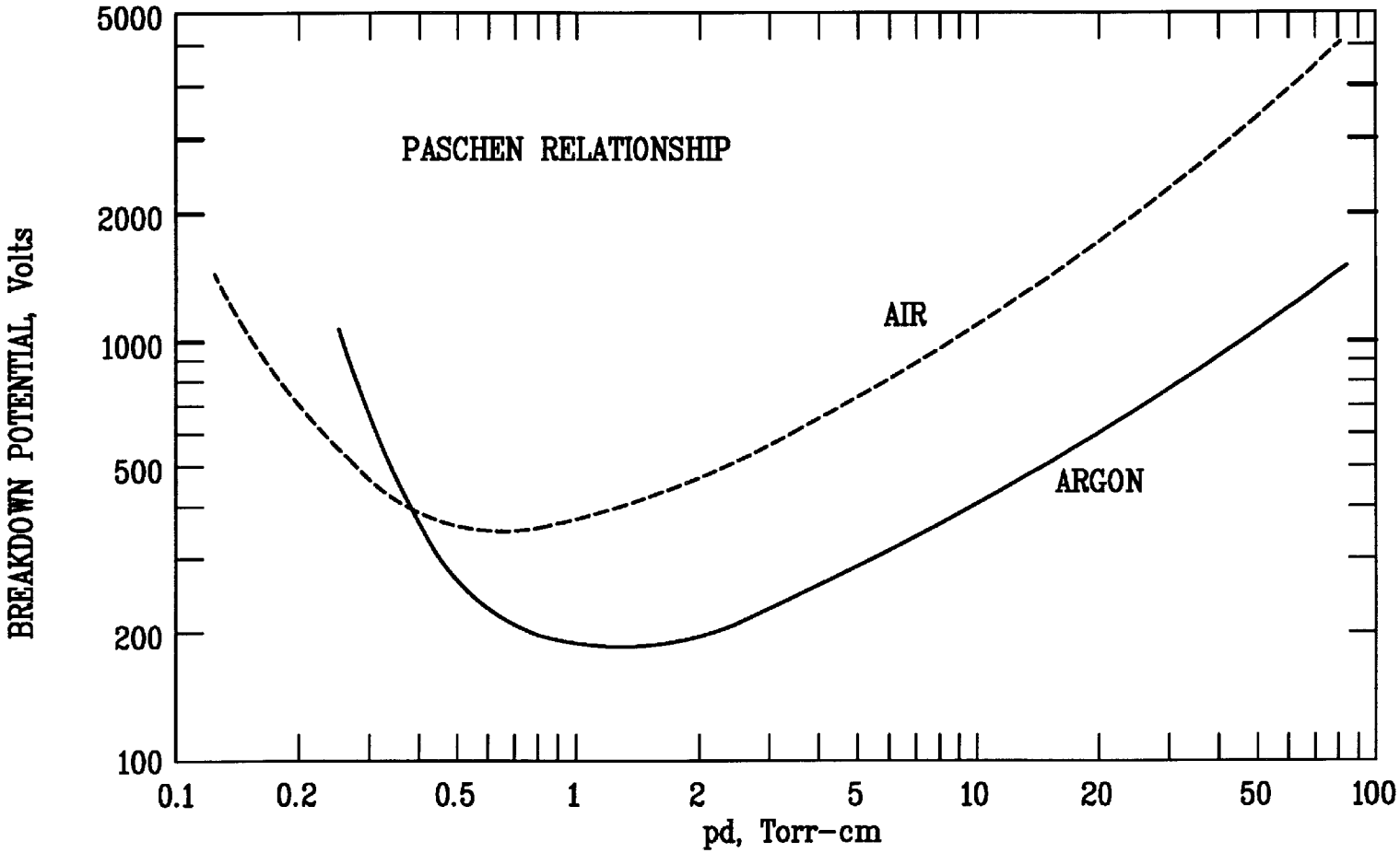
FIG. 8 Prior Art
FIG. 8 Illustrates the electrical breakdown behavior of plane-parallel electrodes in air and argon at 20° C.

Equation 2 shows that if L and $R_0$ are reduced in proportion, then the resolution will be maintained for the miniature and microminiature regimes provided that V and $V_Z$ remain unchanged. $V_Z$ is a low value, 10 to 100 V, in the QMS, and clearly need not be changed for miniaturization. However, since V is relatively high, ~1000 V, consideration of the likelihood of electrical discharge is required. For our purposes, the well known Paschen curve (FIG. 8) is an adequate description. Here, the discharge voltage is plotted as a function of the product of pressure and separation distance of two electrodes. The curve is roughly U-shaped with the minimum at approximately 1 Torr-cm. Mass spectrometers operate well to the left of this point where the curve has a large negative slope. In this region, decreasing the electrode gap increases the voltage required to cause a discharge. Thus, miniaturization is a clear benefit and permits operation at higher pressure.

In conclusion, it has been shown that replacing the hot filament on a QMS spectrometer with a cold cathode field emitter array confers important performance improvements. By reducing background contributions and ameliorating unwanted catalytic conversion, this approach reduces pumping and power requirements leading to substantial savings in weight and size. Simple considerations of mean free path and the Paschen curve indicate additional relaxation of vacuum requirements upon miniaturization made possible by the inherent small size of FEAs.

What is claimed is:

1. A method for analyzing the mass of a material sample, said method comprising the steps of:

(a) providing a low voltage field emission array, said array comprising a plurality of emissions tips and emissions gates;

(b) applying an electrical potential difference between said plurality of emission tips and said emission gates, said potential difference sufficient to initiate quantum tunneling at said emission tips thereby generating a flux of electrons generating an electron flux;

(c) directing said electron flux into an acceleration tube and thence into an ionization region, wherein said acceleration tube has a potential sufficient to prevent electrons emitted from said emission tips from shorting to said emission gates;

(d) introducing molecules from an analyte sample into said ionization region wherein collisions between said flux of electrons and said molecules result in dissociation of at least some of said analyte sample molecules;

(e) directing at least some of said dissociated molecules into a mass filter, said mass filter capable of sequentially selecting dissociated molecules having a specific charge-to-mass ratio thereby permitting only said selected dissociated molecules to pass into a detector means; and (f) scanning a specific charge-to-mass ratio or across a range of charge-to-mass ratios.

2. The method of claim 1, wherein said step of scanning further includes detecting a relative abundance of said dissociated molecules passed by said mass filter at every selected charge-to-mass ratio thereby generating a charge-to-mass ratio spectrum of said analyte sample.

3. The method of claim 1, wherein said step of scanning further includes detecting a relative abundance of those dissociated molecules passed by said mass filter at said specific charge-to-mass ratio during a specific interval of time thereby permitting comparison of the relative time varying abundance of said dissociated molecule.

4. The method of claim 1, wherein the mass filter is a multipole mass filter.

5. The method of claim 4, wherein the mass filter is a quadrupole mass filter.

* * * * *